United States Patent [19]

Taguchi et al.

[11] 4,400,648

[45] Aug. 23, 1983

[54] IMPREGNATED CATHODE

[75] Inventors: Sadanori Taguchi, Tokyo; Yukio Honda, Fuchu; Toshiyuki Aida, Chofu; Ushio Kawabe, Tokyo, all of Japan

[73] Assignee: Hitachi, Ltd., Tokyo, Japan

[21] Appl. No.: 192,870

[22] Filed: Oct. 1, 1980

[30] Foreign Application Priority Data

Oct. 1, 1979 [JP] Japan ..... 54-125403

[51] Int. Cl.[3] ..... H01J 1/14

[52] U.S. Cl. ..... 313/346 R; 313/346 DC

[58] Field of Search ..... 313/346 R, 346 DC

[56] References Cited

U.S. PATENT DOCUMENTS 2,722,626 11/1955 Coppola et al. ..... 313/346 R
2,798,182 7/1957 Costa ..... 313/346 R
2,813,220 11/1957 Coppola et al. ..... 313/346 DC
3,148,056 9/1964 Brodie et al. ..... 75/206

*Primary Examiner*—Harold A. Dixon
*Attorney, Agent, or Firm*—Antonelli, Terry & Wands

[57] ABSTRACT

An impregnated cathode having a complex porous body of one-body construction which is mounted in a metal sleeve and in which a partition layer made of a porous material having a porosity less than 17% is arranged in close contact with an impregnated layer made of a porous material containing an electron emissive material. The aforementioned porous partition layer takes the place of the conventional partition plate of refractory metal. The impregnated cathode according to the present invention can not only have its size reduced without any difficulty but also enjoy a high emission current density with a remarkably small dispersion.

11 Claims, 7 Drawing Figures

IMPREGNATED CATHODE

BACKGROUND OF THE INVENTION

The present invention relates to an impregnated cathode for use in an electron tube such as Braun tube or a camera tube, and more particularly to an impregnated cathode having a porous metal body of improved construction.

An impregnated cathode has a porous metal body which is impregnated with an electron emissive material composed majorly of an oxide of rare earth metal such as Ba. As this porous metal body, there has usually been used a porous body of refractory metal such as tungsten, molybdenum, tantalum, rhenium or nickel. The porous metal body impregnated with such electron emissive material has a sleeve mounted thereon and a heater attached thereto, thus fabricating the desired impregnated cathode. The sleeve is usually made of refractory metal such as molybdenum, tantalum or tungsten. On the other hand, the heater is usually made of a tungsten wire and is formed thereon with an alumina coating layer all over the tungsten wire.

Now, when the impregnated cathode having the construction thus far described is operated until its temperature reaches a normal operating temperature, i.e., 1000° C. the Ba compound is liberated from the porous metal body to the heater so that it steals into the insulating alumina coating layer, which is formed on the surface of the heater wire, to deteriorate the insulating property of the heater until the impregnated cathode becomes unfit for use. In order to obviate such disadvantage, a partition plate of refractory metal has been disposed in contact with the heater side of the porous metal body in accordance with the prior art, thus preventing Ba or its compound from being liberated. FIG. 1 is a sectional view showing one example of the impregnated cathode according to the prior art. Indicated at reference numeral 1 is a porous tungsten body which is impregnated with an electron emissive material containing a Ba oxide or the like. Indicated at numeral 2 is a sleeve which is made of molybdenum or tantalum. Indicated at numeral 3 is a partition which is also made of molybdenum or tantalum and which is formed into such a cup shape as is suitable to be adhered to the sleeve 2 and the porous tungsten body 1. The partition 3 is welded or brazed at its adhered position 4 to the sleeve 2 and is brazed at its adhered position 5 to the porous tungsten body 1. Incidentally, illustration of the heater is omitted from FIG. 1.

The conventional impregnated cathode having the metal partition described in the above can be fabricated with relative ease either in case a porous metal body having such a relatively large size as makes the diameter of the cathode as large as several millimeters is used or in case the sleeve is made so thick as has a thickness as large as about 0.1 mm. However, both in the case of a small cathode such as a cathode having a diameter at most 1.5 mm for use in the Braun tube or the camera tube and in the case of a thin cathode made as thick as about 20 μm with a view to reducing the power consumption, the impregnated cathode having the construction with the aforementioned metal partition is difficult to produce with the resultant increase in its production cost. In the impregnated cathode according to the aforementioned prior art, moreover, it is difficult to braze the porous metal body and the partition in a complete manner all over their contacting surfaces, and there is established a gap inbetween thereby to reduce the thermal efficiency so that the emission current density is reduced. Still moreover, since the respective cathodes are different among their gap or bonded areas, there arises a large dispersion in the thermal efficiency and accordingly in the emission current density.

Generally speaking, the impregnated cathode has its Ba or the oxide thereof evaporated during its operation from the impregnating electron emissive material so that the content in the impregnating electron emissive material is reduced with the time lapse until the impregnated cathode becomes unfit for use. In order to elongate the lifetime of the impregnated cathode, therefore, it is sufficient that the quantity of impregnation of the electron emissive material is increased. For this purpose, it is necessary either to enlarge the porous metal body or to increase the porosity of the same. However, in the former case of the enlarged porous metal body, the power consumption by the heater is increased whereas in the latter case of the porous metal body having the increased porosity the rate of evaporation of the electron emissive material is increased, both of the cases being undesired.

SUMMARY OF THE INVENTION

It is, therefore, an object of the present invention to provide an impregnated cathode which is free from the aforementioned difficulties concomitant with the prior art. More specifically, the object of the present invention is to provide an impregnated cathode which is equipped with a partition having an improved construction.

In order to attain the aforementioned object, the impregnated cathode according to the present invention is equipped with a complex porous body of one-body construction, in which a partition layer made of a porous material having a porosity less than 17% is disposed in contact with an impregnated layer made of a porous material containing an electron emissive material. The aforementioned complex porous body is mounted in a metal sleeve such that the aforementioned partition layer is arranged to face a heater which is disposed in said metal sleeve.

DESCRIPTION OF THE PREFERRED EMBODIMENTS

Figure 1:
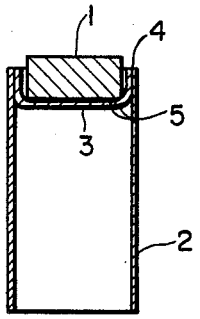
FIG. 1 is a sectional view showing an impregnated cathode according to the prior art.

The aforementioned partition layer made of a porous material corresponds to the metal plate partition in the impregnated cathode according to the prior art. The reason for setting the porosity of thereof less than 17% is because, if the porosity becomes equal to or higher than 17%, all the existing pores become continuous so that the electron emissive material in the impregnated layer comes, during the operation, out to the heater side surface of the partition layer through the continuous pores thereby to liberate the Ba or its compound to the heater side, thus failing to attain the purpose aiming at producing the partition layer. Although the porosity of the porous material composing the partition layer is preferred the more if it is the lower, there is a limit, e.g., about 2% under a usual condition in the technique of fabricating the complex porous body by the pressing and sintering processes.

On the other hand, the porosity of the porous material composing the impregnated layer is set at 17 to 30%. In case this porosity is less than 17%, the continuation of the existing pores becomes incomplete thereby to make it impossible to impregnate all the pores with the electron emissive material and for the Ba to reach the electron emitting surface through the pores. Therefore, the porosity less than 17% should be obviated. On the contrary, if the porosity exceeds 30%, the rate of evaporation of the Ba and its compound is so remarkably increased as to shorten the lifetime of the cathode and to adversely affect the other electrodes in the electron tube.

The metal making the porous material or materials of the impregnated layer and the partition layer may be any of the metals which are used to make the porous metal body of the conventional impregnated cathode. The material metal may usually be selected from a group consisting of tungsten, molybdenum, tantalum, rhenium and nickel or may be an alloy containing at least two of those metal elements. Especially, tungsten and molybdenum are most often used. The porous material making the impregnated layer and the porous material making the partition layer are usually the same metal but may be different.

The electron emissive material may be any of those which are used to make the conventional impregnated cathode and is at least one of the oxide which is especially selected from a group consisting of BaO, CaO, MgO, SrO and $Al_2O_3$, (which does not imply an oxide of alkali rare earth metal). The electron emissive material generally contains BaO. The material having such a composition as is expressed by a general formula of $4BaO.Al_2O_3.CaO$ is excellent in its electron emitting property so that it is fit for the electron emissive material to be used to make the impregnated cathode.

The thickness of the partition layer is usually made at least about 0.025 mm. In case this thickness is less than 0.025 mm, it often takes place that at most eight to ten metal particles making the porous material are distributed in the direction of thickness, thus making it insufficient to prevent the electron emissive material from being liberated to the heater side. Incidentally, in case ten or more particles making the porous material are distributed in the direction of thickness, a partition layer having a thickness equal to or less than 0.025 mm can be used. In case, however, the thickness becomes equal to or less than 0.025 mm, the production by the pressing and sintering processes becomes difficult. On the other hand, even if the thickness of the partition layer is made especially large, any benefit cannot be expected therefrom, but the power consumption by the heater is rather increased to an undesired extent. Thus, the thickness of the partition layer is so preset as to fit for facilitating the production. Generally speaking, it is sufficient that the thickness of the partition layer be preset equal to or less than that of the impregnated layer. The thickness of the impregnated layer causes no problem, if it is within the scope of the thickness of the porous metal body in the conventional impregnated cathode, and is usually preset in most cases at 0.05 to 1.5 mm.

It is desired that the impregnated layer and the partition layer be in close contact with each other all over their contacting surfaces, and this desire can be satisfied with ease by making the two into one sintered body.

The metal sleeve, in which the aforementioned complex porous body, is made of refractory metal such as molybdenum, tantalum or tungsten. The complex porous body thus made is brazed or welded with a laser or electron beam to the metal sleeve.

The heater to be disposed in the metal sleeve may be any of those used in the conventional impregnated cathode and generally uses a wire made of W or a W-Re alloy as a core part thereof and alumina or the like as a coating layer thereof.

Figure 2:
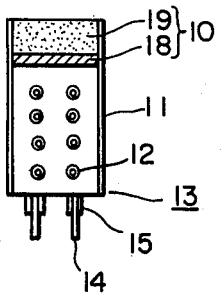
FIG. 2 is also a sectional view showing an impregnated cathode according to one embodiment of the present invention.

FIG. 2 is a sectional view showing one embodiment of an impregnated cathode according to the present invention thus far described. A complex porous body 10, which is composed of an impregnated layer 19 and a partition layer 18, is mounted in one end of a metal sleeve 11. A heater 12 is disposed in the chamber at the other end of the metal sleeve 11. The partition layer 18 and the heater 12 are arranged to face each other. The metal sleeve 11 and the heater 12 are fixed to a stem which is not shown in FIG. 2. Incidentally, reference numeral 14 indicates the core part of the heater 12, whereas numeral 15 indicates the coating layer of the heater 12. Numeral 13 indicates an impregnated cathode thus assembled.

Since the impregnated cathode according to the present invention thus far described has no metal partition, it can be easily fabricated in a small size and with the heater of small power consumption so that it is advantageous in cost. Since, moreover, the impregnated cathode has a one-body construction, in which the impregnated layer and the partition layer are in contact with each other, the emission current density is high with a remarkably small dispersion.

The following description is directed to another impregnated cathode according to the present invention thus far described, in which the quantity of impregnation of the electron emissive material is improved to be increased. In the impregnated cathode thus improved according to the present invention, a penetration layer made of a porous material having a porosity of 17 to 30% is formed in contact with the surface of the impregnated layer of the aforementioned complex porous body, and the porosity of the porous material making said impregnated layer is made larger than that of said penetration layer. In this case, the porosity of the porous material making the impregnated layer may exceed 30% but is desired not to exceed 60%. On principle, both the impregnated layer and the penetration layer are impregnated with the electron emissive material, but only the impregnated layer may be impregnated with the same material. The quantity of impregnation naturally becomes more in case the two layers are impregnated with the electron emissive material. The material making the penetration layer may be selected from the aforementioned metals, which are fit for making the impregnated layer, and is usually tungsten or molybdenum. The porous material making the penetration layer and the porous material making the impregnated layer are usually the same metal but may be different from each other.

The reason why the porosity of the porous material making the penetration layer is set at 17 to 30% is the same as that which has been described as to the impregnated layer of the impregnated cathode having no penetration layer. Since the rate of evaporation of the Ba or its compound is suppressed by the penetration layer in case there exists the penetration layer, the porosity of the porous material making the impregnated layer may exceed 30%. However, if 60% is exceeded, the strength is deteriorated, and the production becomes difficult. Therefore, it is desired that 60% is not exceeded.

The thickness of the penetration layer is usually set equal to or more than about 0.025 mm. In case this thickness is less than 0.025, it often takes place that eight to ten or less metal particles making the porous material are distributed in the direction of thickness. As a result, the action to suppress the excessive evaporation of the electron emissive material may be insufficient. Incidentally, in case ten or more particles making the porous material are distributed in the direction of thickness similarly to the case of the partition layer, the penetration layer can be said usable even if its thickness is equal to or less than 0.025 mm. However, the thickness becomes equal to or less than 0.025, the production by the pressing and sintering processes becomes difficult. On the other hand, even if the penetration layer is made especially thick, any advantage cannot be expected therefrom. The excessive thickness may rather lead to a tendency of excessively suppressing the passage of the Ba, and the power consumption by the heater is increased to an undesirable extent. Generally speaking, it is sufficient that the thickness of the penetration layer be equal to or less than that of the impregnated layer.

Figure 3:
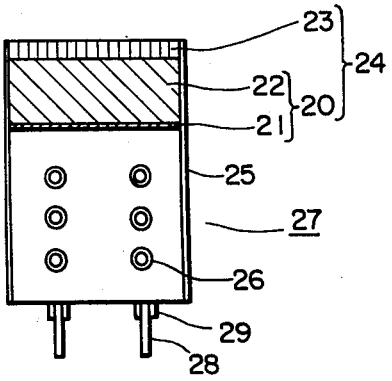
FIG. 3 is also a sectional view showing an impregnated cathode according to another embodiment of the present invention.

FIG. 3 is a sectional view showing one embodiment of an impregnated cathode having the aforementioned penetration layer according to the present invention. There is mounted in one end of a metal sleeve 25 a multilayered porous body 24, in which a penetration layer 23 is arranged in close contact with the surface of the impregnated layer 22 of a complex porous body 20 composed of a partition layer 21 and the impregnated layer 22. A heater 26 is disposed in the chamber at the other end of the metal sleeve 25. The partition layer 21 and the heater 26 are arranged to face each other. The metal sleeve 25 and the heater 26 are fixed to a stem which is not shown in FIG. 3. Incidentally, reference numeral 28 indicates the core part of the heater 26, whereas numeral 29 indicates the coating layer of the heater 26. Numeral 27 indicates an impregnated cathode thus assembled.

The impregnated cathode having the penetration layer according to the present invention thus far described can enjoy not only all the advantages, which are owned by the aforementioned impregnated cathode formed with the partition layer and the impregnated layer but not with the penetration layer, but also the advantage that it is impregnated with more electron emissive material than the prior art while supplying the electron emitting surface with a desired quantity of barium. As a result, the impregnated cathode having the penetration layer according to the present invention has an advantage that it can have its lifetime elongated without reducing its electron emmisivity.

In order to fabricate the aforementioned impregnated cathode according to the present invention, the partition layer made of a porous material having a porosity less than 17% is prepared as the partition portion, which acts to maintain the electric insulation of the heater, simultaneously and integrally with the porous material making the impregnated layer. On the other hand, in case the cathode formed with the penetration layer for suppressing the excessive evaporation of the electron emissive material is to be fabricated, a porous material layer, which has a porosity lower than that of the porous material making the impregnated layer and ranging from 17 to 30%, is prepared at the electron emitting surface side of the impregnated layer simultaneously and integrally with the complex porous body which is composed of the partition layer and the impregnated layer.

In one representative of the fabrication of the conventional impregnated cathode, for example, a sintered body of tungsten is first prepared and is impregnated with copper so that it may be easily machineworked. After that, the sintered body is cut into a preset shape. Then, the impregnating copper is evaporated to prepare a porous metal body, which is then impregnated with an electron emissive material. A metal sleeve is then mounted on the porous metal body thus prepared. The impregnated cathode can naturally be fabricated by the use of the conventional fabricating method described in the above.

However, the impregnated cathode according to the present invention can also be fabricated by the following method. The powders of the porous material are press-molded into a cathode shape, e.g., a disk shape. This molding is sintered into a sintered body having a preset shape, which is impregnated as it is with the electron emissive material with neither the impregnation with copper nor the cutting process. Then, the metal sleeve is mounted on the impregnated body. The method thus far described is more excellent than the conventional method having the impregnating step with copper in that the fabricating steps are simplified and in that an excellent electron emissivity can be obtained with the reduced dispersion in the emitting characteristics.

Figure 4:
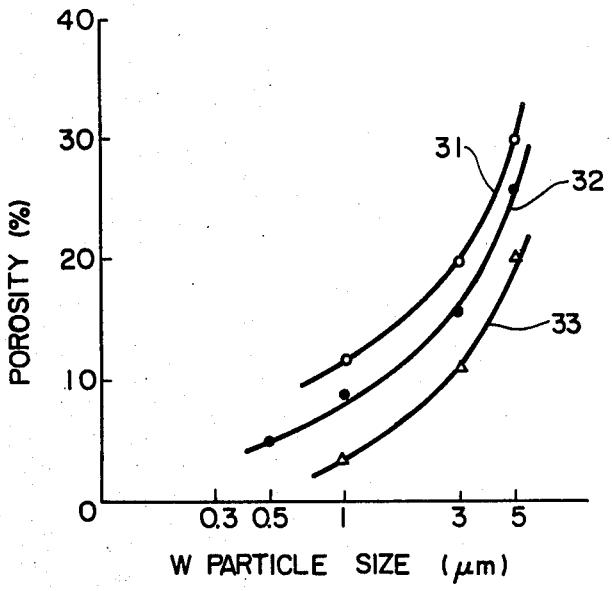
FIG. 4 is a graph illustrating the relationships between the particle diameter of material powders of tungsten in case a sintered body of tungsten is fabricated by sintering a press molding and the porosity of a sintered body fabricated.
Figure 5:
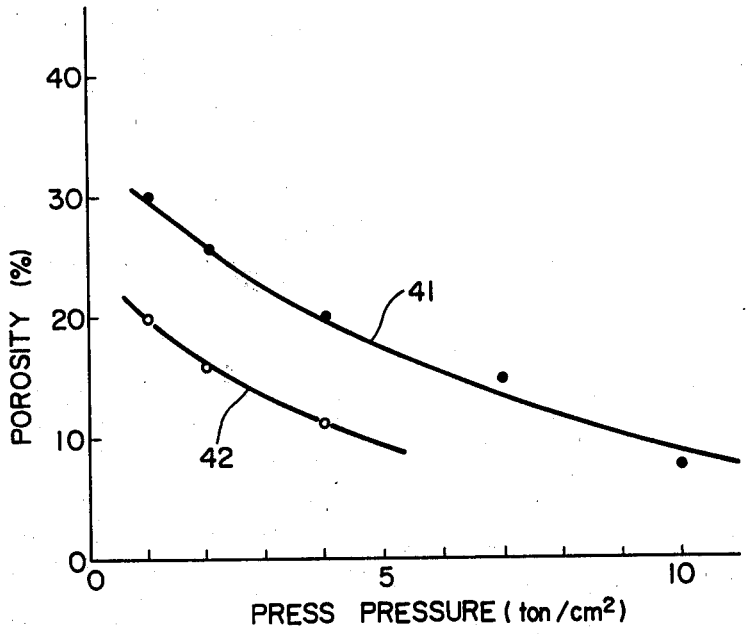
FIG. 5 is a graph illustrating the relationships between the press molding pressure in case a sintered body of tungsten is fabricated by sintering a press molding and the porosity of the sintered body fabricated.

The porosity of the porous material due to the sintering process can be adjusted by the particle size of the material powders, the press molding pressure, the sintering temperature, the sintering time and so on. In case the press molding pressure and the sintering conditions are constant, generally speaking, the porosity is increased the more for the larger diameter of the material powders. FIG. 4 is a graphical presentation illustrating the relationships between the particle sizes of the material powders of tungsten and the porosities of the sintered body of tungsten prepared under the press molding pressures of 1 ton/cm$^2$ (curve 31), 2 tons/cm$^2$ (curve 32) and 4 tons/cm$^2$ (curve 33), at the sintering temperature of 1900° C. and for the sintering time of 2 hrs. It is found from FIG. 4 that the porosity of the prepared sintered body is increased the more for the larger diameter of the material powders and for the lower press molding pressure. The fact that the porosity of the sintered body is increased for the lower press molding pressure is apparent from FIG. 5, too. FIG. 5 is a graphical presentation illustrating the relationships between the press molding pressures and the porosities of the sintered body of tungsten prepared for the particle diameters of the tungsten material powders of 5 μm (curve 41) and 3 μm (curve 42), at the sintering temperature of 1900° C. and for the sintering time of 2 hr. Moreover, the porosity is decreased the more for the higher sintering temperature and for the longer sintering time.

In case it is intended to fabricate a sintered body of one-body construction, which is composed of a plurality of layers having different porosities, as in the case of the impregnated cathode according to the present invention, there can be conceived a method, in which material powders having a preset particle size are press-molded under a preset pressure into a one-layered press molding. With at least one of the particle size and the press molding pressure being varied, then, the material powders, which are placed on the aforementioned one-layered press molding, are press-molded together with the aforementioned press molding. These steps are repeated with at least one of the particle size and the press molding pressure being further varied, if necessary, thereby to prepare a press molding of one-body construction having a plurality of layers, which is then sintered. According to another method conceivable, a one-layered sintered body is first prepared by the press molding and sintering steps. The material powders are then placed on that sintered body and are press-molded and sintered under the fabricating conditions made different from the precedent steps. These steps are repeated, if necessary, to prepare a sintered body of one-body construction composed of a plurality of layers having different porosities. Comparing the two fabricating methods thus far described, it can be said that the former method is more advantageous than the latter method in that the steps are simplified.

Since the sintering conditions are unchanged in the case of the former fabricating method, the adjustment of the porosity is effected by varying the particle size of the material powders and the press molding pressure. In case the same material powders are used, therefore, the porosity is adjusted by varying only the press molding pressure so that the sintered body having a layer of higher porosity sandwiched therein cannot be prepared. In order to prepare the sintered body having the layer of higher porosity, the particle size of the material powders has to be varied. By effecting the press molding and sintering steps while suitably selecting both the particle size of the material powders and the press molding pressure for the respective layers, it is possible to easily prepare a sintered body of one-body construction, in which the layers having different porosities are arranged in a desired manner.

The porous sintered body of one-body construction fabricated by the aforementioned manner while being composed of the plural layers having different porosities is impregnated with the electron emissive material from its electron emitting surface side, i.e., from the surface of the penetration layer, if any, and from the surface of the impregnated layer if there is no penetration layer. After that, the porous sintered body thus impregnated is either brazed or welded with a laser or electron beam to the metal sleeve. A cathode having similar characteristics can be fabricated no matter which step of impregnating the porous sintered body with the electron emissive body or mounting the same body in the sleeve is made precedent. Incidentally, both the sleeve and the heater are attached to an identical stem.

EXAMPLE 1

A press jig of cylindrical shape having a diameter of 3.5 mm (an outside diameter of 38 mm and a height of 35 mm) was prepared. Tungsten powders having mean particle sizes of 1, 3 and 5 μm were prepared as material powders and were weighed at 15 mg, 32 mg and 89 mg, respectively. First of all, 15 mg of the tungsten powders having the particle size of 1 μm were filled in the press jig and were press-molded under a pressure of 392 Kg (or 4 tons/cm$^2$). Secondly, 89 mg of the tungsten powders having the particle size of 5 μm were filled in the press jig and were pressed under a pressure of 166 Kg (or 2 tons/cm$^2$) applied. After that, 32 mg of the tungsten powders having the particle size of 3 μm were filled in the press jig and were press-molded under a pressure of 33 Kg (or 1 ton/cm$^2$). The press moldings thus obtained were sintered in a vacuum electric furnace at a sintering temperature of 1900° C. for two hrs to prepare the multi-layered porous body 24 which was composed of three layers having different porosities, as shown in FIG. 3. The multi-layered porous body 24 thus sintered and made of tungsten had a diameter of 3.25 mm and a thickness of 1.1 mm. The layer 21 used the powders having the diameter of 1 μm and had a thickness of about 0.1 mm. The layer 22 used the powders having the diameter of 5 μm and had a thickness of about 0.75 mm. The layer 23 used the powders having the diameter of 3 μm and had a thickness of about 0.25 mm. The porosities of the layers 21, 22 and 23 were determined from their thicknesses. As a result, the layer 21 was found to have its sintered state advanced as high as 4%. On the other hand, the layers 22 and 23 were found to have sintered states of 26% and 19%, respectively. These values were found substantially equal to those which were attained by the experiments of the single bodies. The multi-layered porous body 24 of tungsten thus prepared was heated in the atmosphere of hydrogen at a temperature of about 2000° C. so that it was brazed by the use of a ruthenium solder containing 41.6 at % of molybdenum to the sleeve 25 which was made of molybdenum while having an inside diameter of 3.26 mm, an outside diameter of 3.45 mm and a length of 7 mm. When the multi-layered porous body 24 was to be mounted in the sleeve 25, it was arranged such that its layer 23 acted as the electron emitting surface. The soldering process was accomplished all over the circumference of the multi-layered porous body 24. On the multi-layered porous body 24 thus having the sleeve fixed thereto, there was placed a compound having a composition of 4 $BaO.Al_2O_3.CaO$, which was heated in the atmosphere of hydrogen at 1740° C. for three minutes so that the impregnation with the electron emissive material was effected to fabricate the impregnated cathode 27. The electron emissive material left after the impregnating step was removed, and the tungsten heater 26 having the alumina coating layer was mounted. Thus, the impregnated cathode 27 thus fabricated was operated by a diode system. As a result, the quantity of the substance evaporated from the electron emitting surface was small, and no substance was found to be evaporated to the heater 26. And, the insulating property of this heater 26 was absolutely unchanged from that before the operation test. Moreover, the impregnating condition of the electron emissive material at the cut surface of the impregnated cathode, which is cut at a right angle with respect to the electron emitting surface, was analyzed with the use of an X ray microanalyzer of nondispersive type. The results revealed that the layer 21 was impregnated with no electron emissive material whereas the layers 22 and 23 had their pores impregnated as a whole with the electron emissive material.

EXAMPLE 2

Similarly to the Example 1, a cylindrical press jig having a diameter of 1.5 mm (and having an outside diameter of 38 mm and a height of 35 mm and formed with eight holes having a diameter of 1.5 mm) was used. Tungsten powders having a mean particle size of 5 μm were prepared and were weighed at 5 mg and 13 mg. First of all, 5 mg of the tungsten powders were filled in the press jig and were pressed under a pressure of 177 Kg (10 tons/cm$^2$). Next, 13 mg of the tungsten powders were filled in the jig and were press-molded under a pressure of 35 Kg (2 tons/cm$^2$). The press molding thus obtained was heated and sintered at 1900° C. in a vacuum electric furnace for two hrs. The complex porous body 10 of tungsten was composed, as shown in FIG. 2, of the layer 18, which had a high porosity (or a high press pressure), and the layer 19, which had a low porosity (or a low press pressure to provide the electron emitting side) and had an outside diameter of 1.39 mm and a height of 0.68 mm. The former layer 18 had a thickness of about 0.16 mm whereas the latter layer 19 had a thickness of about 0.52 mm. The porosities of the layers 18 and 19 were 7% and 26.4%, respectively. The complex porous body 10 thus prepared was heated in the atmosphere of hydrogen at 1740° C. for three minutes so that it was impregnated with the electron emissive material having the mixed compound of $4BaO.Al_2O_3.CaO$. After that, the complex porous body 10 was inserted into the sleeve 11 of molybdenum, which had an inside diameter of 1.4 mm, a thickness of 25 μm and a height of 6.2 mm, and was heated at 2000° C. so that it was brazed all over its circumference to that sleeve 11 with the use of the Ru solder containing 41.6 %, thus fabricating the impregnated cathode 13. Then, the tungsten heater 12 having the alumina coating layer was mounted. After that, the impregnated cathode thus fabricated was set in a dummy tube and was operated at 1050° C. for 2000 hrs. This operation test revealed that the electric insulation of the heater had been maintained and that no deterioration in the electron emissivity had taken place.

Figure 6:
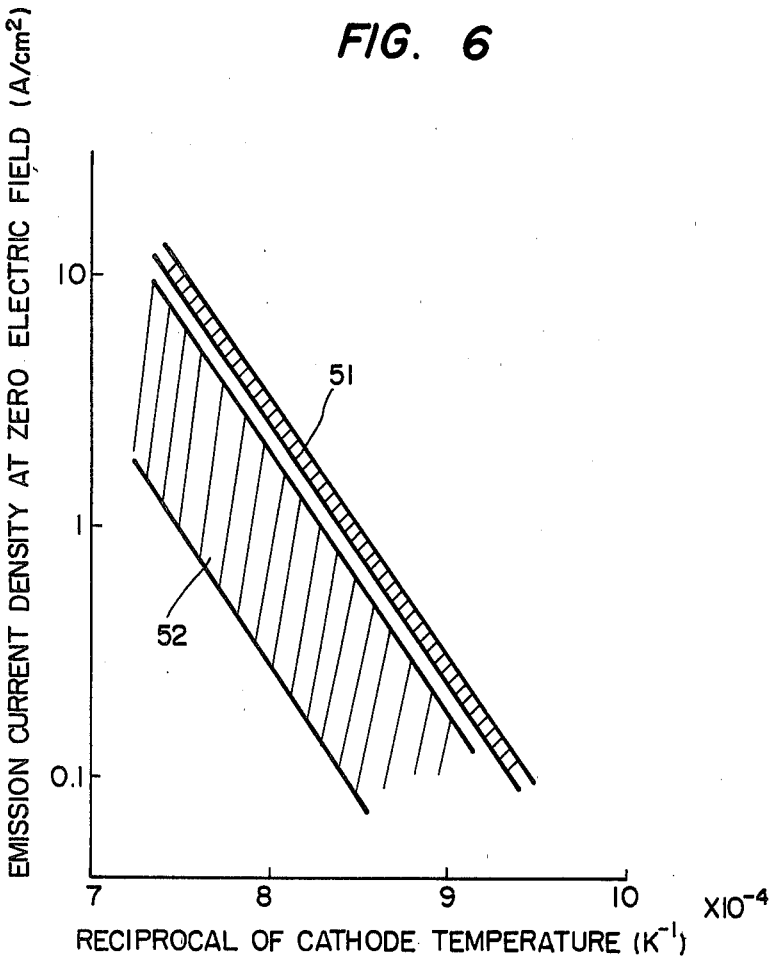
FIG. 6 is a graph illustrating the relationships between the reciprocals of the cathode temperatures of the impregnated cathodes according to the one embodiment of the present invention and according to the prior art and the emission current densities at a zero electric field.

On the other hand, the emission current was metered with the cathode temperature in the operation test being varied, and the relationships between the reciprocals of the cathode temperature and the emission current densities were illustrated in FIG. 6. In FIG. 6, zone 51 corresponds to the case of the impregnated cathode according to the present invention whereas zone 52 corresponds to the case of the conventional impregnated cathode of the type, in which the metal partition was brazed to the porous sintered body of tungsten. As is apparent from FIG. 6, the conventional impregnated cathode is inferior in performance to that according to the present invention in that the former has a lower emission current density and in that the emission current density itself of the former is highly dispersed. Incidentally, the aforementioned impregnated cathode according to the prior art is wholly the same as that of the present Embodiment except for the partition portion.

EXAMPLE 3

Figure 7:
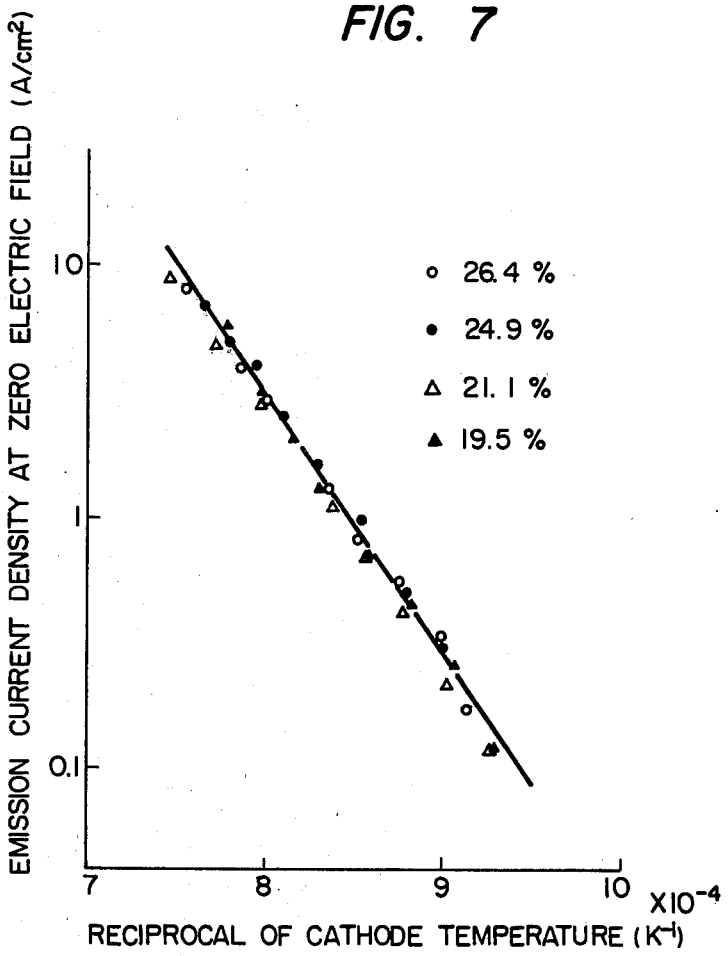
FIG. 7 is a graph illustrating the relationships between the reciprocals of the cathode temperatures of the impregnated cathode in case the porosity of the porous material composing the impregnated layer in the embodiment of the present invention is varied and the emission current densities at the zero electric field.

An impregnated cathode was fabricated similarly to the Example 2 except for the fact that the porous sintered body of tungsten making the impregnated layer was divided into four kinds having porosities of 26.4%, 24.9%, 21.1% and 19.5%. And, the relationships between the reciprocals of the cathode temperature and the emission current densities were determined by a similar method to that in the Example 2. The determined results are illustrated in FIG. 7. As is apparent from FIG. 7, the electron emitting characteristics of the impregnated cathode according to the present invention are not varied in the least but are remarkably stable even if the porosity of the porous material making the impregnated layer is varied within a range from about 19% to about 27%.

Obviously many modifications and variations of the present invention are possible in the light of the above teachings. It is therefore to be understood that within the scope of the appended claims the invention may be practised otherwise than as specifically described.

What is claimed is:

1. An impregnated cathode comprising a complex porous body having a partition layer, an impregnated layer arranged in close contact with the partition layer and made of a porous material containing an electron emissive material, and a penetration layer arranged in contact with the surface of the impregnated layer not adjacent the partition layer; said complex porous body being formed by press-molding powdered material for making said partition layer, said impregnated layer and said penetration layer to form three layers, and sintering the three layers together to obtain said complex porous body; said complex porous body being mounted in a metal sleeve such that said partition layer is arranged to face a heater which is arranged in said metal sleeve; wherein the partition layer is made of a porous material having a porosity of at least about 2% and less than 17% and the penetration layer is made of a porous material having a porosity of 17–30% and in which the porosity of the porous material making said impregnated layer is made larger than that of the porous material making said penetration layer.

2. An impregnated cathode according to claim 1, further characterized in that the porosity of the porous material making said impregnated layer ranges from 17% to 30%.

3. An impregnated cathode according to claim 1, further characterized in that the porosity of the porous material making said impregnated layer is equal to or less than 60%.

4. An impregnated cathode according to claim 1, further characterized in that said penetration layer is impregnated with an electron emissive material, too.

5. An impregnated cathode according to claim 1, further characterized in that the thickness of said penetration layer is equal to or larger than 0.025 mm.

6. An impregnated cathode according to any one of claims 2, 4 to 6 or 1, further characterized in that the thickness of said partition layer is equal to or larger than 0.025 mm.

7. An impregnated cathode according to claim 1, wherein the porous material of the partition layer, the porous material of the impregnated layer and the porous material of the penetration layer are made of a material selected from the group consisting of tungsten, molybdenum, tantalum, rhenium and alloys containing at least two thereof.

8. An impregnated cathode according to claim 7, wherein the porous material of the partition layer, the porous material of the impregnated layer and the porous material of the penetration layer are made of the same material.

9. An impregnated cathode according to claim 1, wherein the porous material of the partition layer and the porous material of the impregnated layer are made of a material selected from the group consisting of tungsten, molybdenum, tantalum, rhenium and alloys containing at least two thereof.

10. An impregnated cathode according to claim 9, wherein the porous material of the partition layer and the porous material of the impregnated layer are made of the same material.

11. An impregnated cathode according to claim 1, wherein the porosity of the porous material of said impregnated layer is greater than the porosity of the porous material of said partition layer.

* * * * *